United States Patent [19]

Kamisaka et al.

[11] 4,018,026

[45] Apr. 19, 1977

[54] AUTOMATIC CONTINUOUS BARREL FILLING METHOD

[75] Inventors: Makoto Kamisaka; Kanji Kojima; Tatsuya Negoro; Toshichika Uchikubo; Yusho Okamoto, Honishi; Sadao Minato, all of Mihara, Japan

[73] Assignee: Mitsubishi Jukogyo Kabushiki Kaisha, Japan

[22] Filed: Dec. 15, 1975

[21] Appl. No.: 640,760

Related U.S. Application Data

[62] Division of Ser. No. 469,852, May 14, 1974, Pat. No. 3,977,154.

[52] U.S. Cl. ..... 53/37; 53/281; 53/367; 141/171; 141/165

[51] Int. Cl.² ..... B65B 1/04; B65B 43/60

[58] Field of Search ..... 53/37, 35, 43, 282, 53/281, 367, 276; 198/258, 259, 246, 247; 141/171, 165; 214/340

[56] References Cited

UNITED STATES PATENTS

| | | | |
|---|---|---|---|
| 3,181,842 | 5/1965 | Eckert | 214/340 UX |
| 3,610,398 | 10/1971 | Rice | 141/171 X |
| 3,613,332 | 10/1971 | Davis | 53/367 X |
| 3,633,765 | 1/1972 | Bennett et al. | 53/281 X |

*Primary Examiner*—Travis S. McGehee
*Assistant Examiner*—Horace M. Culver
*Attorney, Agent, or Firm*—McGlew and Tuttle

[57] ABSTRACT

An automatic, continuous barrel-filling method comprises the steps of supplying empty barrels, locating the bungholes of the barrels, inserting nozzles into the barrels through the holes, bunging the holes, and carrying the filled barrels out of the filler body, the empty barrels being sequentially and uninterruptedly passed through the foregoing steps thereby to be automatically filled with liquid and conveyed out.

7 Claims, 22 Drawing Figures

(I)

FIG. 2 (II)
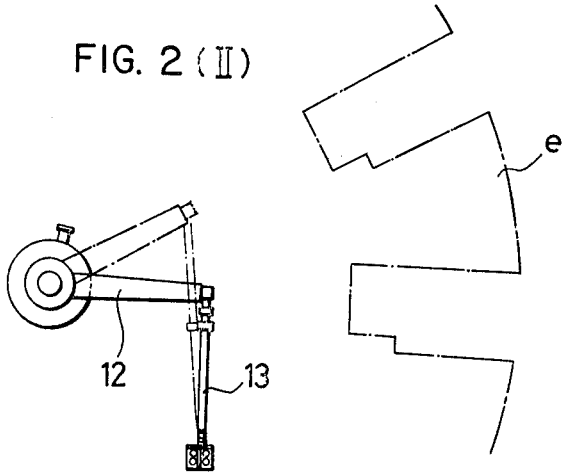
FIG. 2 (III)
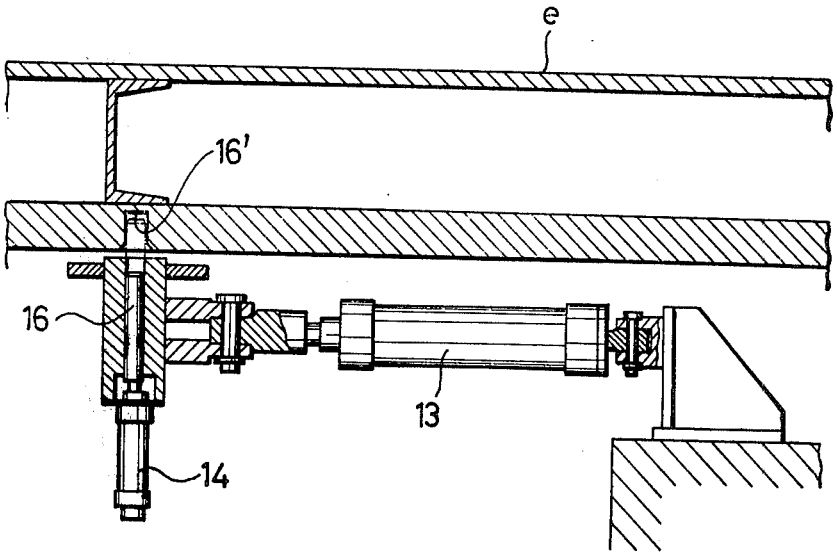

AUTOMATIC CONTINUOUS BARREL FILLING METHOD

This is a division of application Ser. No. 469,852 filed May 14, 1974, and now U.S. Pat. No. 3,977,154.

FIELD AND BACKGROUND OF THE INVENTION

This invention relates to a method of automatically and continuously filling casks or barrels with liquids and an apparatus therefor.

Prior art barrel-filling machines used in racking whiskey, beer, wine, etc. have had common disadvantages of poor efficiency and high filling cost because of the human assistance they need in locating bungholes of empty barrels, in filling, and in bunging the filled containers.

SUMMARY OF THE INVENTION

It is is principal object of the present invention to automatize all of the manual steps usually involved in the racking operation.

Another object of the invention is to provide an automatic, continuous barrel-filling method whereby all the steps of empty barrel feeding, bunghole locating, nozzle insertion, filling, bunging, and delivery of filled barrels can be performed without human attention, thus attaining an improved efficiency while reducing the labor content and therefore the cost of the racking operation.

A further object of the invention is to provide an automatic, continuous barrel-filling method whereby empty barrels are automatically fed in succession, their bungholes are automatically located regardless of any variation in barrel size, a nozzle is automatically inserted into each bunghole, liquid is injected upon the insertion of the nozzle into each barrel to a predetermined level regardless of any irregularity in the barrel capacity, the filled barrel is automatically bunged, and these filled barrels are delivered out automatically and continuously.

BRIEF DESCRIPTION OF THE DRAWINGS

Other objects and advantages of the invention will become apparent from the following description taken in conjunction with the accompanying drawings, wherein:

FIG. 2(I) is an enlarged sectional view taken along the line A—A in FIG. 1;

FIG. 2(III) is an enlarged side view, partly in section, of the parts shown in FIGS. 2(I) and (II);

DESCRIPTION OF THE PREFERRED EMBODIMENT

Figure 1:
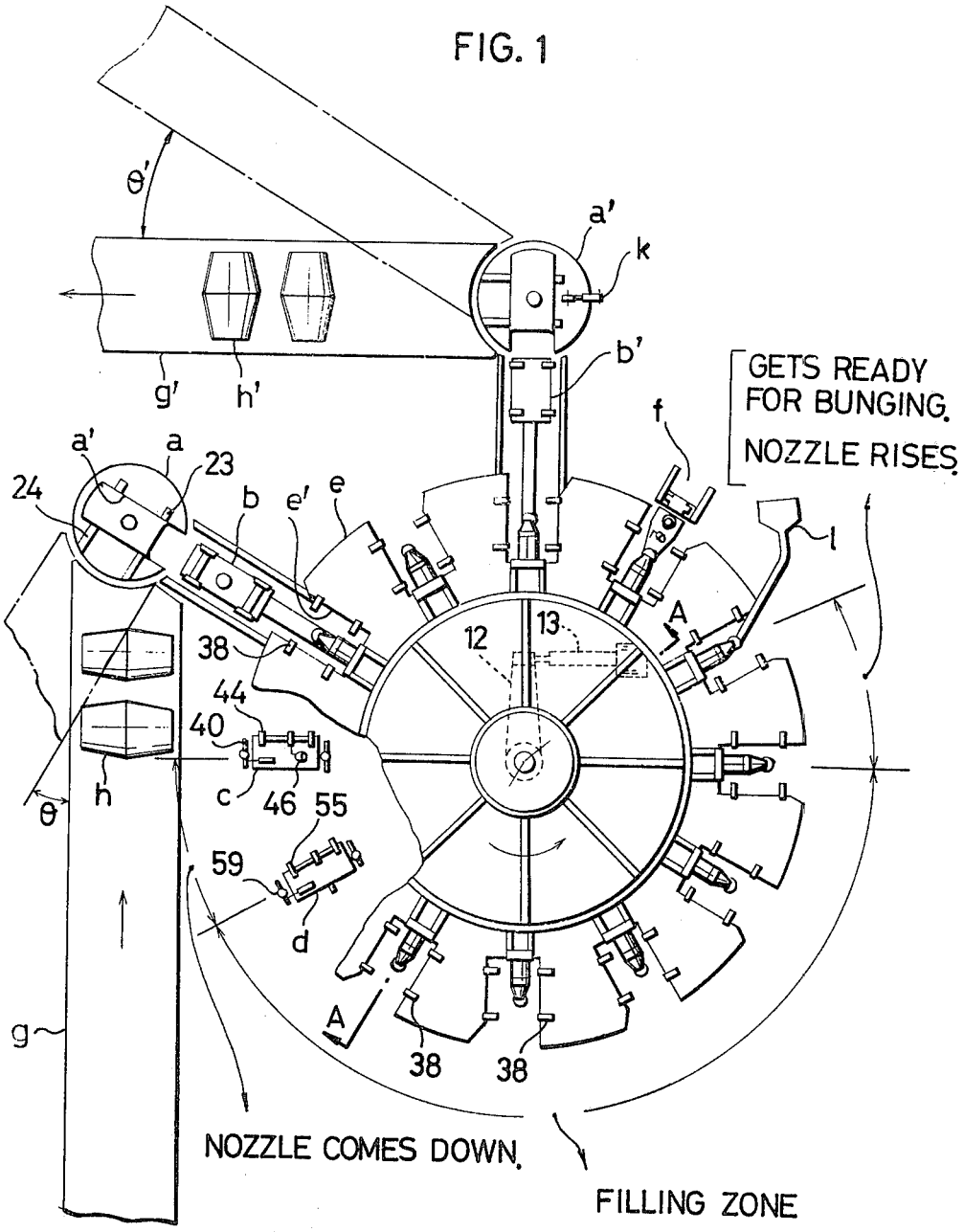
FIG. 1 is a diagrammatic plan view of an apparatus for practicing the method of the invention, partly broken away to show the inner construction.

Referring now to FIG. 1, there is schematically shown an automatic barrel filler according to the present invention, as comprising combined barrel receiver-turn-tables *a*, *a'*, an automatic empty-barrel feeder *b* (hereinafter called a "barrel carry-in dolly") for transferring an empty barrel from the combined barrel receiver-turntable *a* onto a main turntable *e* of the filler body while, at the same time, centering the barrel, a high-speed barrel-rotating unit *c* for locating the bunghole of the empty barrel, a low-speed barrel-rotating unit *d* for enabling a nozzle to be inserted through the bunghole, a bunger *f*, an empty-barrel supplying conveyor *g*, a filled barrel delivering conveyor *g'*, a filled-barrel discharger *b'* (hereinafter called a "barrel carry-out dolly") which, in contrast to the barrel carry-in dolly that handles an empty barrel *h*, carries a filled barrel *h'* out, a barrel kicker *k*, and a bung feeder 1.

Figure 2:
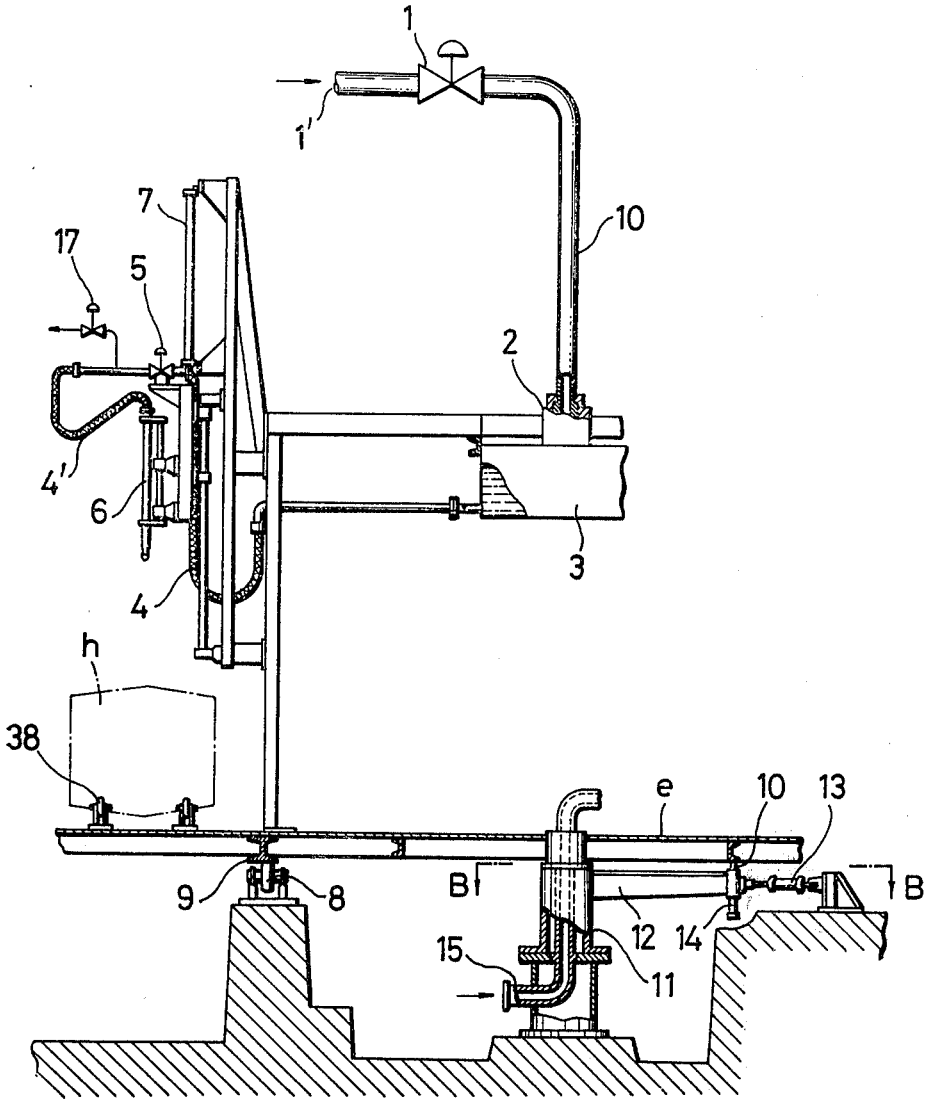
FIG. 2(II) is a sectional view taken along the line B—B in FIG. 2(I)

Now, with reference to FIG. 2(I) which is a detailed section through the filler body on the line A—A of FIG. 1, the feed line for liquid, e.g., whiskey, and the main turntable will be described.

As shown, the line includes a stop valve 1 which can be closed in response to a signal from a control panel when the filler is to be kept inoperative for an extended period or in an emergency such as a leakage. A liquid inlet is indicated at 1'. Also shown are a coupling 2 connecting a rotating container 3 to a stationary pipe 10 of the line, flexible hoses 4, 4', a solenoid valve 5, a nozzle 6 for injecting liquid, such as whiskey, into an empty barrel *h*, a cylinder 7 for raising and lowering the nozzle, one of the rollers 8 supporting the body for rotation, and a rail 9.

The body has, at the center of its rotation, a center bearing 11, to which an arm 12 is fixed, with its free end connected to a horizontal cylinder 13 and also carrying a vertical cylinder 14 having a pin 16 at its upper end. As shown better in FIGS. 2(II) and (III), the drive cylinder unit for the filler body works in such a way that the cylinder 14 raises the pin 16 into engagement with a hole 16' formed on the underside of the main turntable *e*, so that the cylinder 13 rotates the turntable through a predetermined angle, say 30°, and then the cylinder 14 draws the pin 16 downward from the hole 16', enabling the cylinder 13 to retract to its original position.

A plurality of such holes 16' are formed on the underside of the main turntable *e*, in a number suitably chosen depending on the desird angle of rotation.

In order to take in necessary compressed air from the outside, a connection tube 15 is led through the center bearing of the main turntable. An automatic valve 17 is provided which, after the filling of a barrel with whiskey or the like, replaces the liquid down to the nozzle tip by air.

The combined barrel receiver-turntable *a* and the barrel carry-in dolly *b* will be described in connection with FIGS. 3 to 8.

Figure 3:
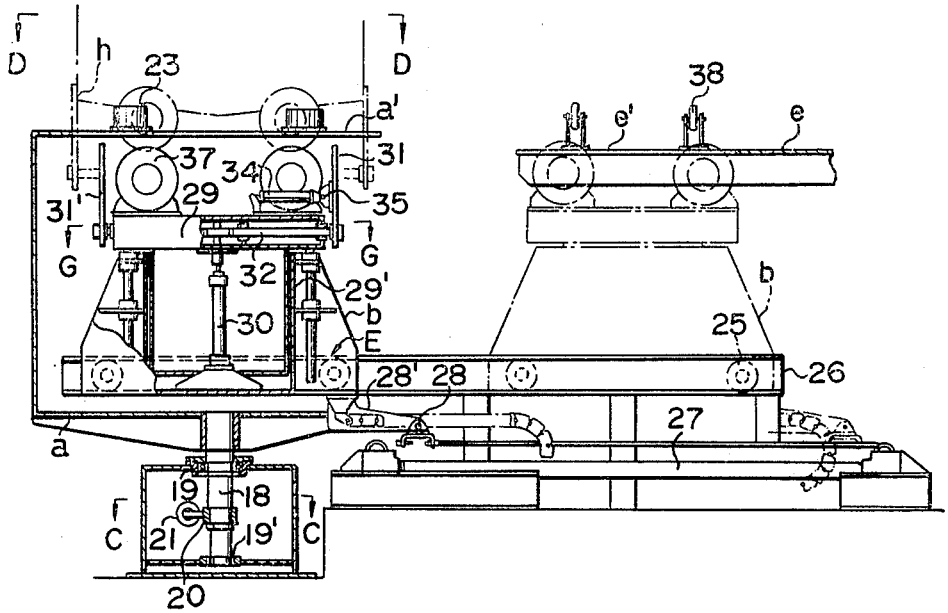
FIG. 3 is an enlarged front view, partly broken away, of a combined barrel receiver-turntable and a barrel carry-in dolly shown in FIG. 1.
Figure 4:
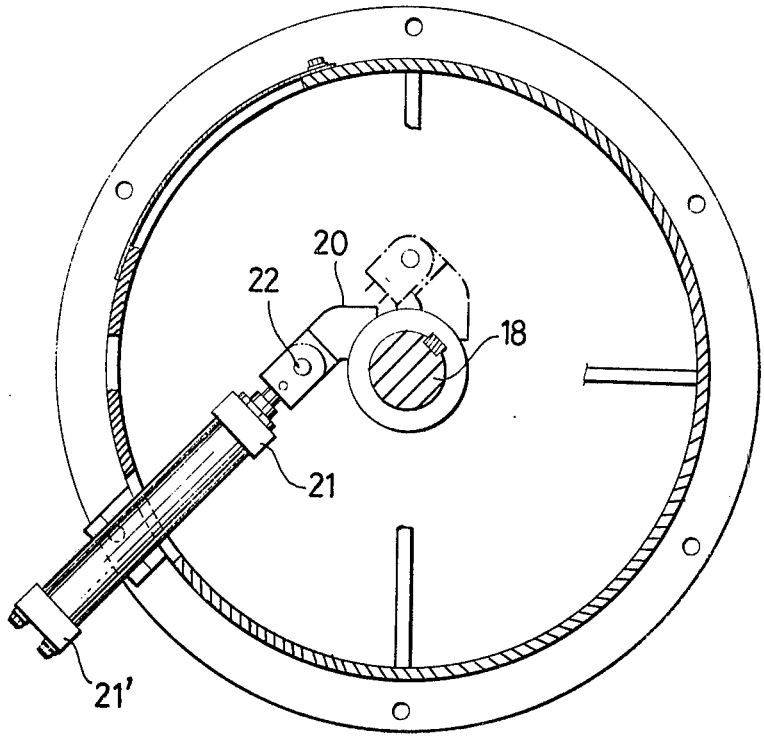
FIG. 4 is an enlarged sectional view taken along the line C—C in FIG. 3.
Figure 6:
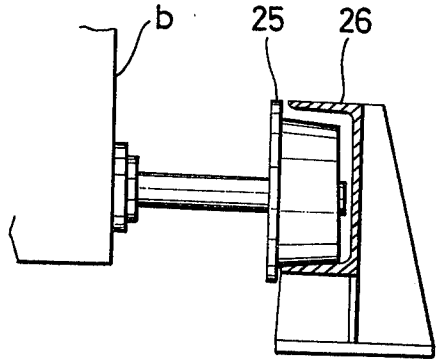
FIG. 6 is an enlarged view, partly in section, of the part E encircled by a broken line in FIG. 3.

Referring first to FIGS. 3 and 4, the combined barrel receiver-turntable *a* has a rotating shaft 18 extending downward from the center of its underside, and is supported by bearings 19, 19' on the shaft. Midway between the bearings the shaft 18 is engaged with a collar arm 20, which is connected to a cylinder 21 via a pin 22, the cylinder in turn being connected at the other end 21' to an anchor member on the machine frame. As the cylinder 21 is actuated, its piston is extended forward and backward to rotate the arm 20, shaft 18, and turntable *a*, via the pin 22, through a desired angle (e.g., 30° in the embodiment shown).

Figure 5:
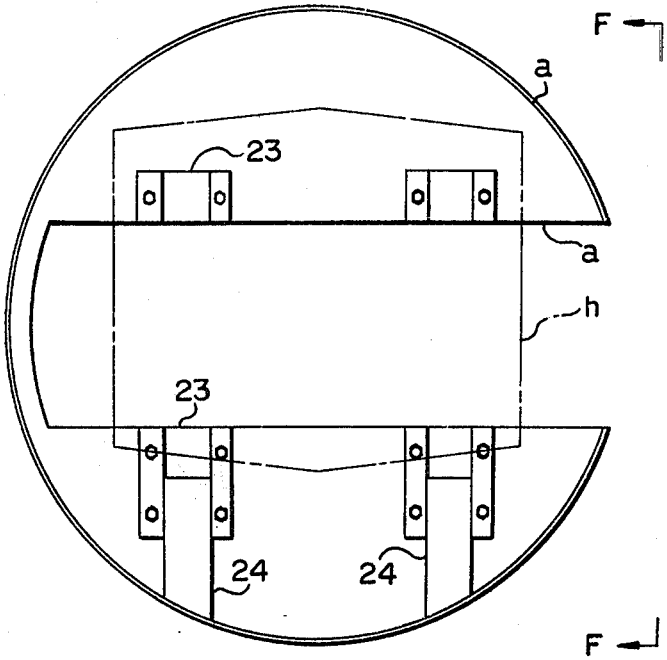
FIG. 5 is an enlarged view as seen in the direction of arrows D—D in FIG. 3.
Figure 7:
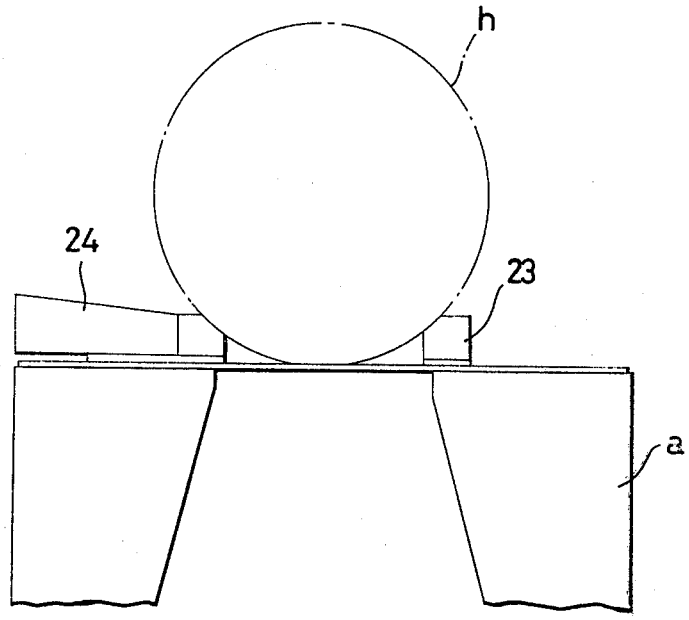
FIG. 7 is an enlarged view as seen in the direction of arrows F—F in FIG. 5.

On the turntable *a* are installed stoppers 23 and inclined rails 24 for facilitating the receipt of a barrel (FIGS. 5 and 7). Moreover, as shown in FIG. 5, the floor of the turntable *a* is cut out to provide a U-shaped recess large enough to permit the barrel carry-in dolly *b* to move up and down therein.

The barrel carry-in dolly *b* has wheels 25 with which to ride on rails 26 (FIG. 6), and can travel to the left and right as viewed in FIG. 3 upon actuation of a cylinder 27 through a pin 28 and a bracket 28'.

Figure 8:
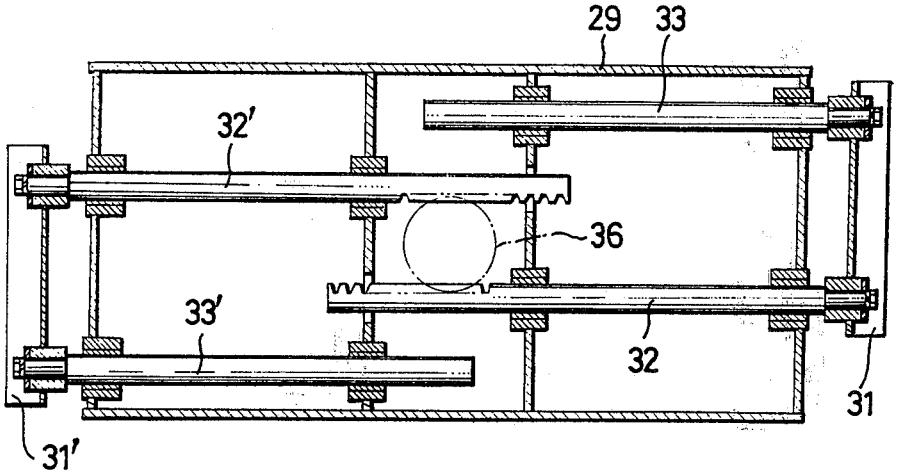
FIG. 8 is an enlarged sectional view taken along the line G—G in FIG. 3.

A liftable table 29 is moved up and down while being guided by guide members 29'. As shown in FIG. 8, a clamp 31 is attached to the liftable table 29 through a rack 32 and a support rod 33. The clamp 31 is connected to a cylinder 34 on the table 29 by a pin 35, so that it can be forced leftward or rightward as viewed in FIG. 3 by the actuation of the cylinder 34. Another clamp 31', located symmetrically with the clamp 31, is similarly provided with a rack 32' and a support rod 33' and is operatively connected to the clamp 31 through the engagement of the rack 32' with a pinion 36 in mesh with the rack 32.

On the liftable table 29, several rollers 37 are rotatably mounted.

Figure 13:
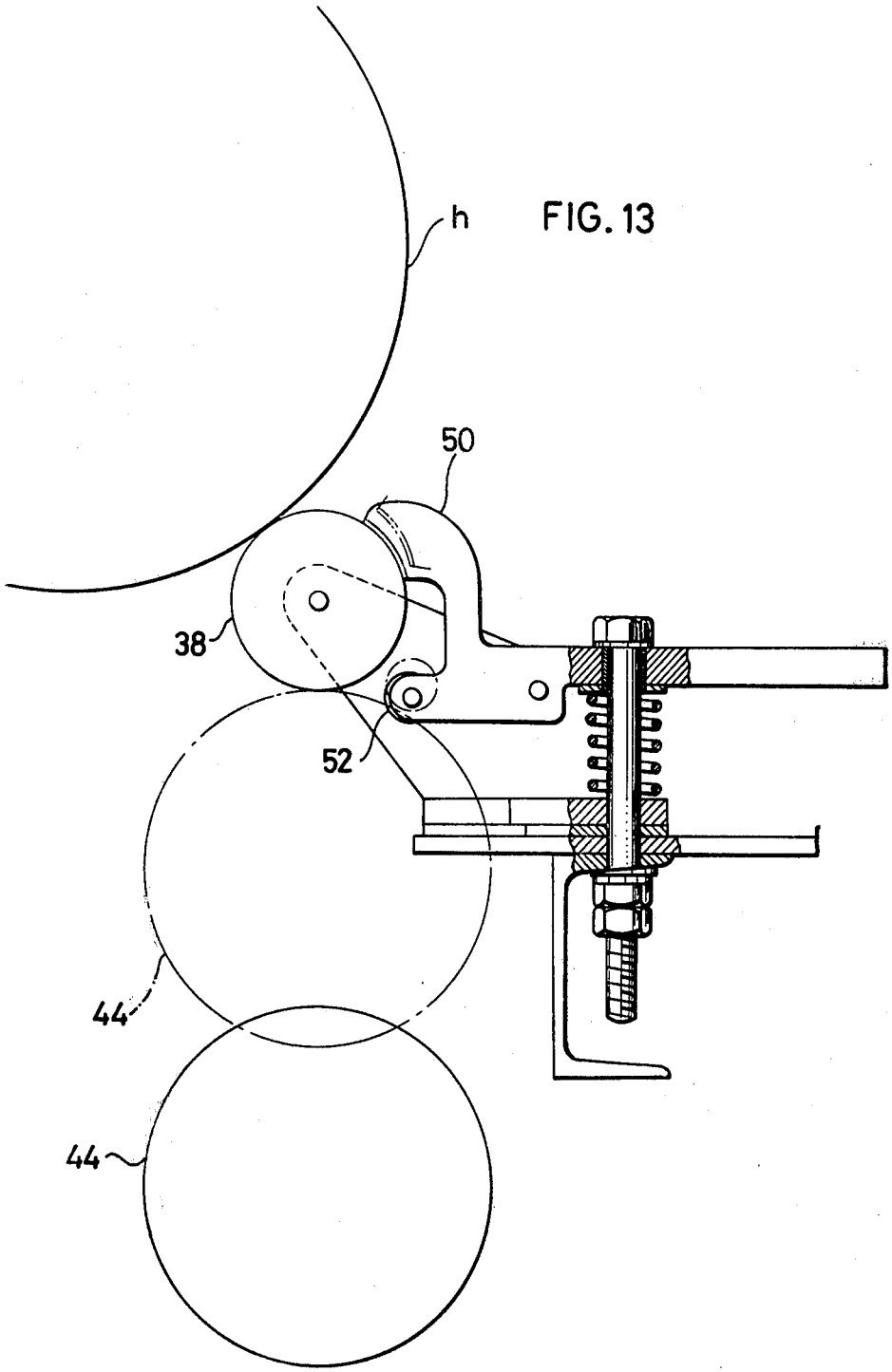
FIG. 13 is an enlarged view of the essential parts shown in FIG. 9.

The main turntable *e* is formed with a plurality of U-shaped radial recesses *e'* which can receive the barrel carry-in dolly *b*. (FIG. 1) On the main turntable are located a plurality of barrel-bearing rollers 38 (in sets of four rollers per recess in the embodiment being described). Of each set of four rollers 38, two are equipped with a braking system as shown in FIG. 13 to interrupt the free rotation of the barrel thereon.

FIGS. 9 through 13 illustrate the bunghole locating unit *c*. If an empty barrel *h* is placed on the barrel-bearing rollers 38 and a cylinder 39 connected to a clamp 40 is actuated, then the clamp 40, in cooperation with another clamp 40' through engagement of racks 41, 41', will press the barrel at the both ends to hold the same securely. This mechanism is similar to the one already described in connection with FIG. 8. In this way a bung-hole 43 in the middle part of the barrel *h* is aligned to the center of the filler, and thus rough centering is accomplished.

Drive rollers 44, fixedly mounted on a shaft 45' over a table 45, are driven by a motor 46 through sprockets and a chain 46' driving the shaft 45'.

Also provided are an instrument box 47, a conventional air jet sensor 48 of the bunghole locating unit, a cylinder 49 for moving the table 45 up and down, brake shoes 50, a driven roller 51 attached to the front end of a driven arm 51', which in turn is pivotally supported by the shaft 45' over the table 45, and brake-releasing rollers 52.

The low-speed barrel-rotating unit *d* and the associated nozzle lifting mechanism will now be described with reference to FIGS. 14 to 17.

Figure 14:
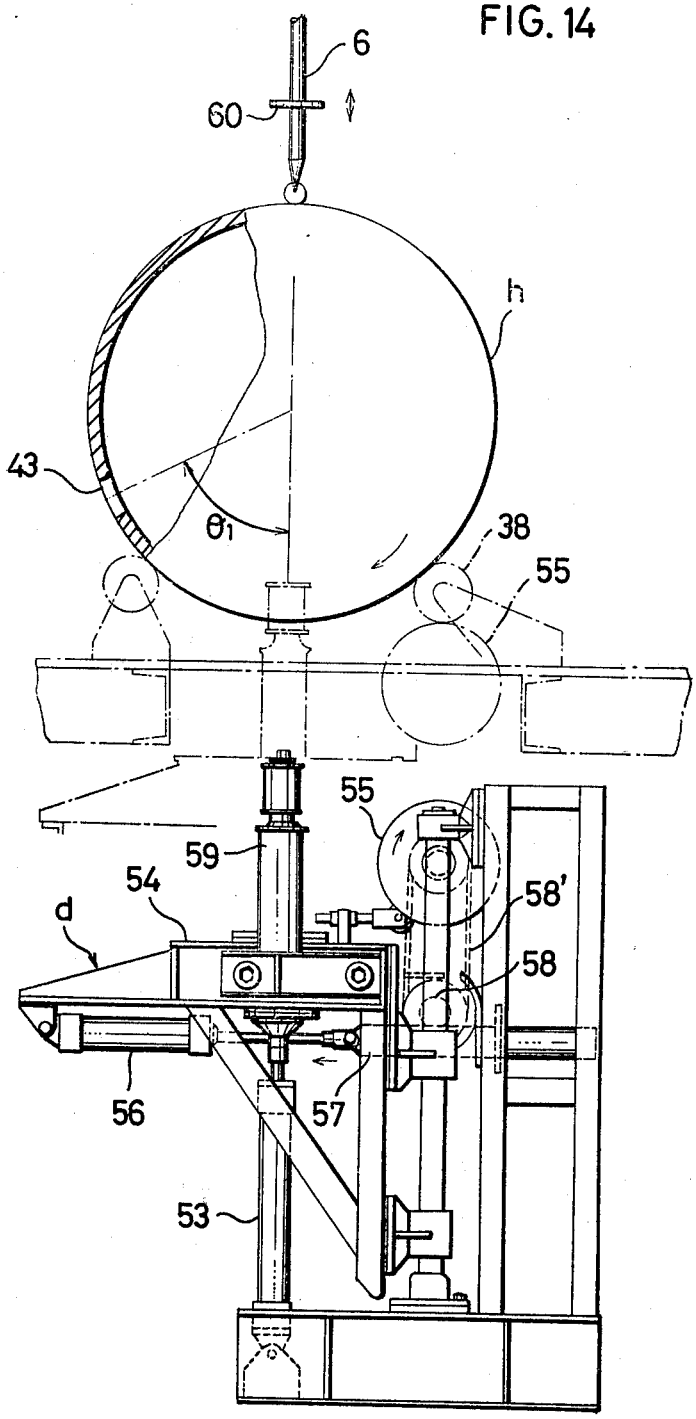
FIG. 14 is an enlarged side view of means shown in FIG. 1 for rotating a barrel at a low speed.

Referring first to FIG. 14, this is a side view of the unit *d* with the nozzle descending toward a barrel placed on the support table. The alternate long and short dashes lines indicate the unit in its up position with the barrel unfettered and rotating at a low speed. As shown, a cylinder 53 is provided to lift a table 54 which supports the drive for low-speed rotation. The table 54 is vertically movably supported with a guide rod 58. Rollers 55, supported above the table 54, are rotated by a cylinder 56 through a rack 57, a pinion 58, and transmission element 58'.

The table 54 is adapted to rise until the rollers 55 come in contact with the barrel-bearing rollers 38. Since the rollers 55 are driven by the cylinder 56 through the rack 57 and pinion 58, and also through sprockets and a chain 58', the barrel *h* is rotated at a low speed through the bearing rollers 38.

Clamps 59 engage the lower rim portions at both ends of the barrel. On the other hand, the nozzle 6 is provided with a stopper 60 for limiting the depth of the nozzle inserted into the barrel.

Figure 15I:
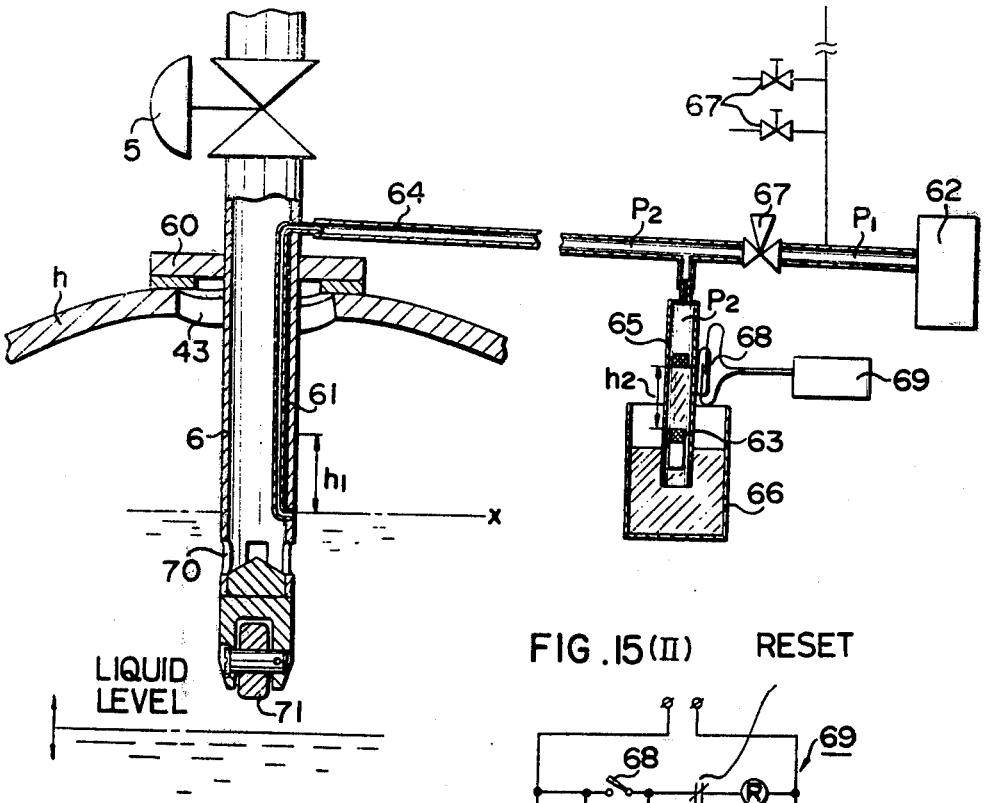
FIG. 15(I) is an enlarged sectional view of liquid-level control means.
Figure 15:
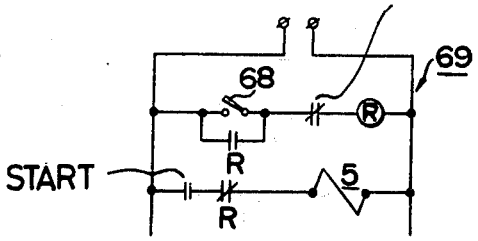
FIG. 15(II) is a diagram of an electrical control circuit for the means shown in FIG. 15(I)

FIG. 15 illustrates the liquid-level control mechanism of the filler according to the invention as comprising, in addition to the vertically movable injection nozzle 6, an equalizing tube 61 fixedly incorporated in the nozzle for vertical movement therewith, the solenoid valve 5 for switching on or off the liquid injection, a vacuum source 62 for supplying and maintaining a constant weak vacuum (50 – 100 mmAg), a guide tube 65 accommodating a magnet-carrying float 63 and connected to the equalizing tube 61 via a pipe 64, a water reservoir 66, a needle valve 67, a reed switch 68, and an electrical control circuit 69. In FIG. 15 the numeral 70 designates one of the liquid outlets, and 71 a roller at the tip of the nozzle 6.

The mechanism for lifting the nozzle will be explained specifically with reference to FIGS. 16 and 17. The mechanism comprises the roller 71 at the lower end of the nozzle 6, a carriage 72, and upper and lower bearings, 73, 73' secured to the carriage. With upper and lower bearings 72', 72'' the carriage 72 is slidably held by a rod member 76, which in turn is supported by the main turntable *e*. Also, the carriage 72 is connected to the cylinder 7 for raising and lowering the nozzle. The nozzle 6 is supported by the upper and lower bearings 73, 73' of the carriage 72 via support members 6', 6'' provided alongside the nozzle. As long as the support member 6' is in contact with the upper side of the upper bearing 73, the nozzle is moved up and down by the vertical motion of the carriage 72. However, once the lower end of the nozzle has touched the barrel *h* via the roller 71 at the nozzle tip, the nozzle will not descend any farther.

Once positioned above the bunghole 43 of the barrel *h* and inserted through the hole, the nozzle 6 will drop by its own weight until the stopper 60 contacts the outer surface of the barrel.

An actuating member 74 is secured to the nozzle 6, in such a manner that, while the lower end of the nozzle is in contact with the barrel surface, upper and lower limit switches 75, 75' installed on the carriage 72 are both engaged with the actuating member 74 to sense that the nozzle 6 is being supported by the barrel *h* and keep the cylinder 7 from further depressing motion. When the stopper 60 has come into contact with the barrel surface due to the insertion of the nozzle into the barrel, both limit switches 75, 75' are out of contact with the actuating member 74, sensing that the nozzle has been inserted into the nozzle.

When there is no empty barrel *h* on the barrel-bearing rollers 38, the piston of the nozzle-lifting cylinder 7 descends to the lower extremity of its stroke, forcing a member 78 fixed to the carriage 72 against a stroke-end limit switch 77 to sense the absence of the barrel.

Figure 18:
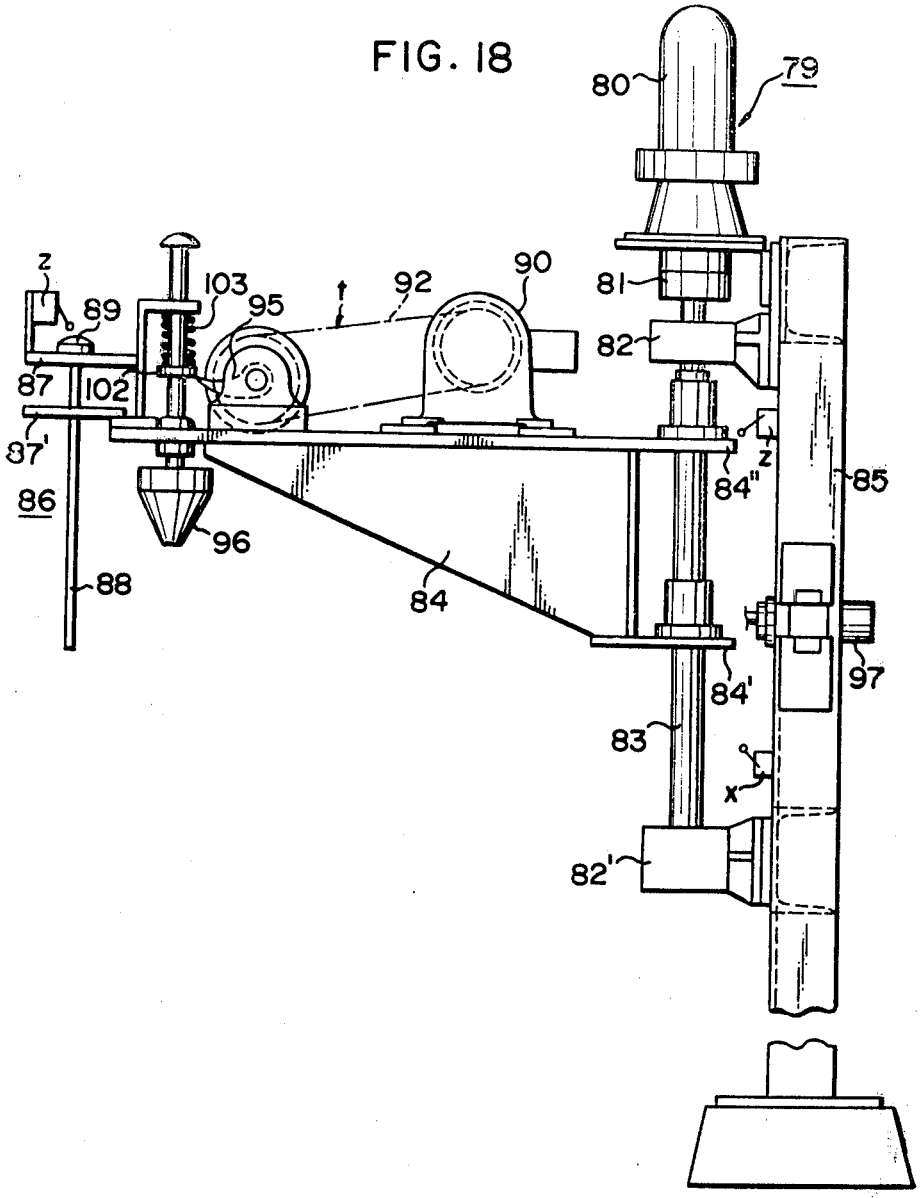
FIG. 18 is a side view of bunger means.
Figure 19:
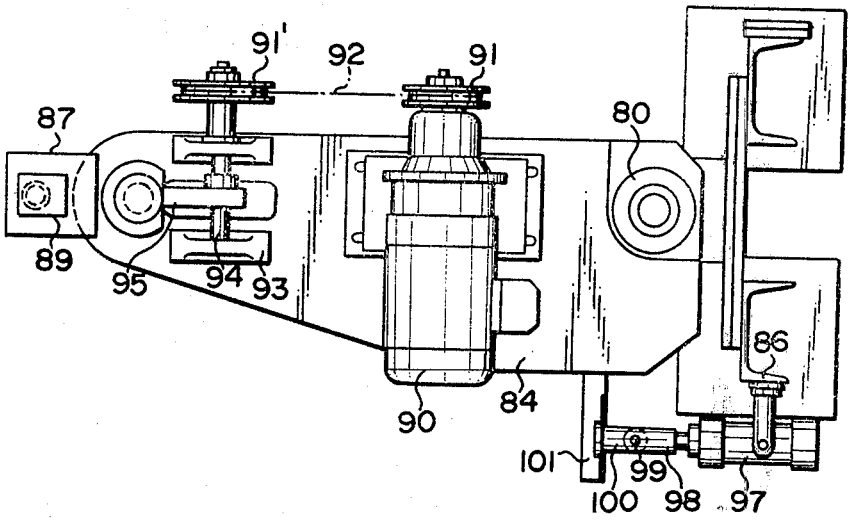
FIG. 19 is a plan view of the same means.

FIGS. 18 and 19 show the bunging mechanism. It comprises a lift, generally indicated at 79, which consists of a lifting motor 80, a lifting shaft 83 connected to the motor through a shaft coupling 81, and bearings 82, 82' that support the shaft. The lifting shaft 83 liftably supports a bracket arm 84. The bearings 82, 82' are secured to a frame 85 held upright in parallel with the shaft.

A sensing mechanism, generally indicated at 86, is made up of support plates 87, 87' at the free end of the bracket arm 84, a barrel sensor bar 88 vertically slidably inserted through holes of the plates 87, 87', and a sensor *z*. At the upper end of the sensor bar 88 is provided a flange 89 for preventing the fall of the bar.

On the movable bracket arm 84 is mounted a bunger *f*, which comprises a bunging motor 90 installed on the arm, pulleys 91, 91', an endless belt 92, bearings 93, a lateral shaft 94 rotatably supported by the bearings, a pawl 95 keyed to the shaft 94, and a spring hammer 96 to be moved up and down by the pawl. For the supply of bungs, a bung feeder *l* of a known type is employed. The upright frame 85 also supports a cylinder 97, which in turn is secured, via a connector 98, a pin 99, and a link 100, to a bracket 101 fixed to a side of the bracket arm 84. The spring hammer 96 has a spring seat 102 and a spring 103 biasing the hammer downward with the aid of the seat.

In the arrangement for discharging filled barrels, the barrel carry-out dolly *b'*, combined barrel receiver-turntable *a'*, and filled-barrel delivering conveyor *g'* are constructed in the same way as the counterparts of the empty-barrel feeding arrangement excepting that they operate reversely.

FIG. 1 also carries a time chart of the barrel-filling operation according to the automatic, continuous method of the invention. There are provided a total of 12 nozzles, and the filler is designed to complete the filling operation in each nozzle position within 30 seconds. Because the filler body is rotated through an angle of 30° at intervals of 30 seconds, it follows that the machine can automatically fill up 120 barrels an hour. It should be obvious to those skilled in the art that the angle of rotation and the time intervals may be freely chosen to predetermine the number of barrels to be filled in a unit time.

The electrical control circuit for the apparatus as a whole may be of a known type conventionally in use, and therefore its description is omitted.

With the apparatus of the invention constructed as above described, the operation will now be described, in the order of the sequential steps of the method for empty-barrel introduction, bunghole locating, nozzle insertion, filling, bunging, and filled-barrel delivery.

Introduction of empty barrels

Empty barrels *h* carried by the conveyor *g* are transferred therefrom one after another onto the combined barrel receiver-turntable *a*. As shown in FIGS. 5 and 7, each barrel is guided by the rails 24 on the turntable *a*, until it is stopped by the stoppers 23. Meanwhile, after the turntable *a* has been supplied with the barrel, the cylinder 21 shown in FIG. 4 is actuated to rotate the turntable through a desired angle $\theta$ so that the axis of the barrel is aligned to the center of the filler (FIG. 1).

Next, the barrel carry-in dolly *b* advances into the U-shaped recess of the combined barrel receiver-turntable *a* and stops immediately below the barel *h*. The cylinder 30 inside the dolly *b* raises the liftable table 29 until the rollers 37 (in a set of four in the embodiment shown) contact the lower surface of the barrel and lift the same (FIG. 3).

Having received the barrel from the turntable, the barrel carry-in dolly *b* is moved back rightward as viewed in FIG. 3 upon the actuation of the cylinder 27 through the pin 28 and the bracket 28'. The dolly is temporarily stopped midway between the turntable and the filler body. As soon as the main turntable *e* of the filler body has completed its angular movement or turn to a point where one of the U-shaped recesses *e'* is ready to receive the dolly, the rightward movement of the dolly is resumed to carry the barrel into that particular recess *e'* of the filler body.

During the rightward movement of the dolly *b*, the cylinder 34 incorporated therein as shown in FIG. 3 operates to move the clamp 31 and, at the same time, the other clamp 31' via the rack 32, pinion 36, and rack 32'. In this manner the barrel is clamped at the both ends and centering is accomplished by aligning the middle point of the barrel (where it is usually bunged) to the axial center of the dolly *b*.

After the dolly has entered the recess *e'* of the filler body and has stopped in position, the piston of the cylinder 30 descends, thus lowering the liftable table 29 and therefore the rollers 37. Consequently, the barrel *h* descends until it is supported at its lower portion by the barrel-bearing rollers 38 on the main turntable *e* of the filler body, when the dolly *b* is relieved of the barrel and begins to move leftward.

BUNGHOLE LOCATING

When the barrel carry-in dolly *b* has moved away from the recess *e'* of the filler body and the empty barrel *h* has been unmovably supported by the barrel-bearing rollers 38 on the filler body, the main turntable *e* turns through a 30° angle and stops, carrying the barrel onto the high-speed barrel-rotating unit *c* equipped with bunghole locating means.

Figure 10:
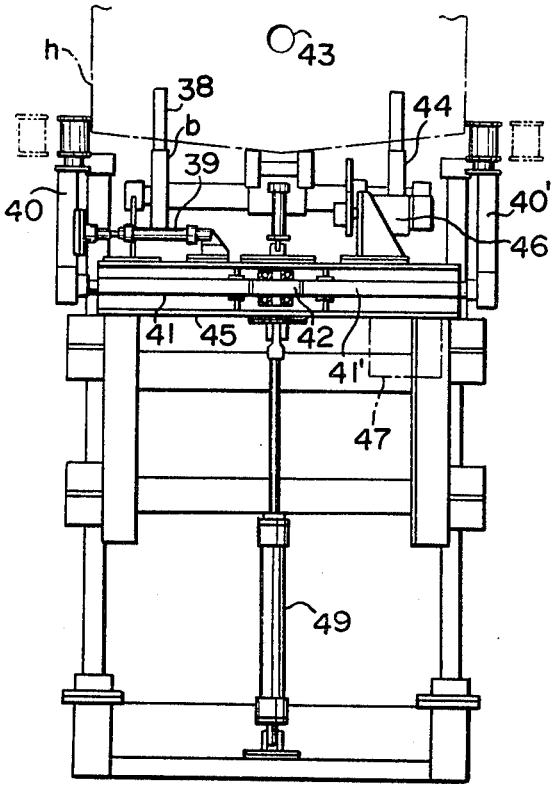
FIG. 10 is a front view of the same means.
Figure 11:
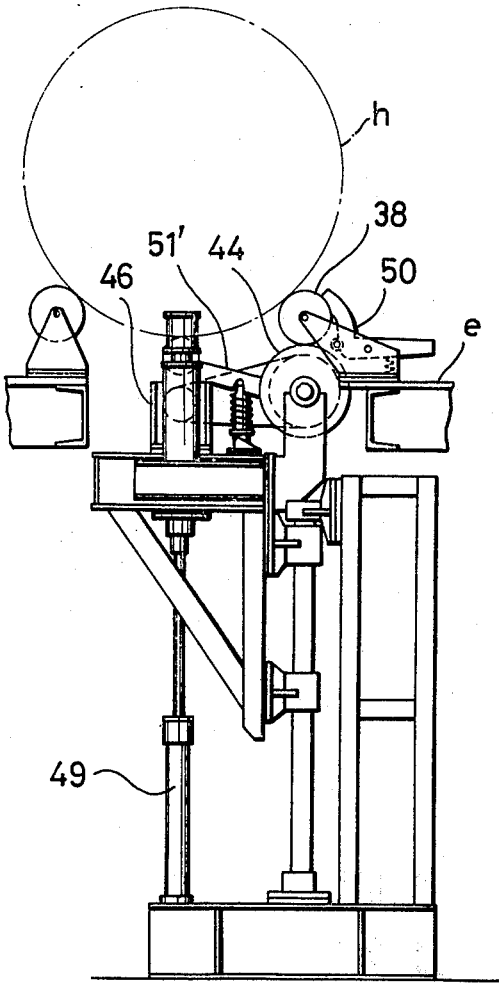
FIG. 11 is a side view of the same means.

Then, the cylinder 49 shown in FIG. 10 lifts the table 45 that carries the high-speed drive, with the result that the drive rollers 44 mounted thereon raise the brake releasing rollers 52 shown in FIG. 13. This moves the brake shoes 50 away from the barrel-bearing rollers 38, thereby releasing the brake. At the same time, the rotation of the drive rollers 44 is transmitted through the barrel-bearing rollers 38 to the empty barrel *h*. The release of the brake with the movement of the brake shoes 50 out of contact with the rollers 38 enables the motor 46 to start in response to a stopping signal from the control panel. The motor is preferably one equipped with a brake or of the hydraulic type for stopping the barrel in position where its bunghole is properly directed.

Figure 9:
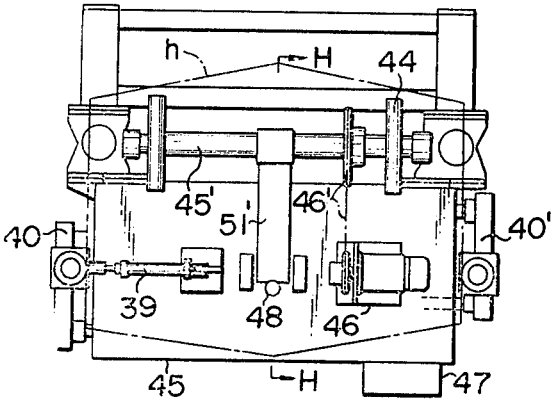
FIG. 9 is an enlarged plan view of means shown in FIG. 1 for rotating a barrel at a high speed to locate its bunghole.

The rotation of the motor shaft is transmitted through the chain and sprockets 46' and the shaft 45' to rotate the drive rollers 44 and the barrel *h* via the barrelbearing rollers 38 (FIGS. 9 and 10). As soon as the barrel begins to turn, it is clamped at the lower portions of its end rims by the clamps 40, 40' that are actuated by the same mechanism as illustrated in FIG. 8. The barrel rotates at a relatively high speed while its bunghole is being centered relative to the locating unit.

Figure 12:
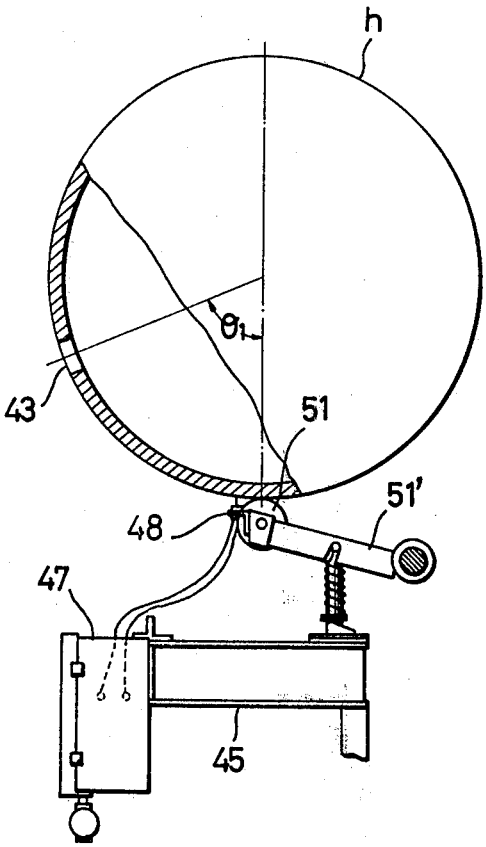
FIG. 12 is an enlarged sectional view taken along the line H—H in FIG. 9.

At the point where the bunghole 43 of the barrel has come to the lowermost position, the back pressure in the air jet sensor 48 of the bunghole locating unit shown in FIG. 12 is changed. This change in back pressure is sensed by a pressure switch (not shown) installed in the control box 47 so that the motor 46 is stopped in a predetermined period of time. Thus the barrel stops with bunghole 43 in a position at an angle of $\theta_1$ to the vertical (FIG. 12).

Following the stopping of the barrel, the table 45 descends and the barrel is automatically set in fixed position on the filler body by the braking means. The roller 51 is attached to the driven arm 51' which in turn is pivotally supported by the shaft 45', in order that the roller 51 be kept in rolling contact with the barrel surface to follow the contour of the barrel as the latter rotates. The air jet sensor 48 is mounted on the boss of the roller 51. This arrangement permits the maintenance of a constant distance between the air jet sensor 48 and the barrel surface, regardless of any irregularity on the latter (FIG. 12).

As the table 45 moves down, the main turntable *e* is turned through another 30° angle, bringing the empty barrel *h* to the position above the low-speed barrel-rotating unit *d*. The cylinder 53 shown in FIG. 14 then lifts the table 54 carrying the low-speed barrel-rotating drive. The rollers 55 release the brake on the barrel-bearing rollers 38, and their rotational forces are directly imparted to the barrel. During this, the barrel is again clamped at the lower rim portions by the clamps 59 lest the barrel should be positioned off-center. Here the bunghole 43 of the barrel is always at an angle of $\theta_1$ from the vertical, and therefore the barrel need only be turned through an angle of $180° - \theta_1$. The barrel is driven at a relatively low speed by the cylinder 56 through the rack 57, pinion 58, rollers 55, and barrel-bearing rollers 38. The angle $\theta_1$ may be changed as desired by adjusting the period of time from the locating of the bunghole to the stopping of the barrel running at high speed, by means of a timer. The rotational speed of the barrel is thus preset to such a value that, when the nozzle 6 drops into the bunghole 43, it is not subjected to any objectionable shock due to the inertia of the barrel just stopped.

NOZZLE INSERTION

Figure 16:
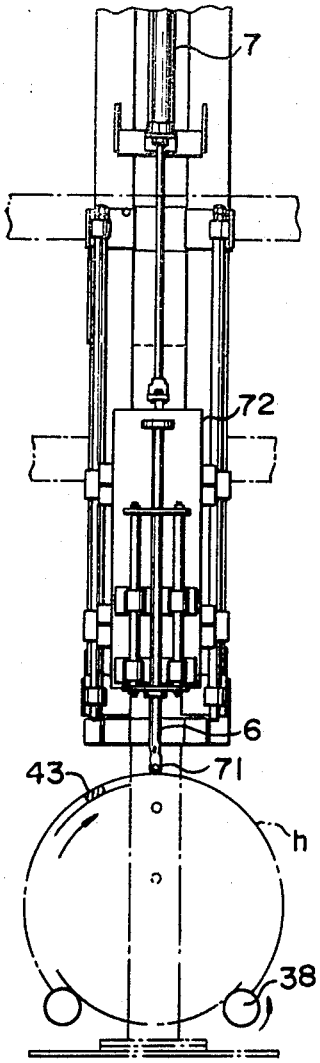
FIG. 16 is a side view of nozzle-lifter means.
Figure 17:
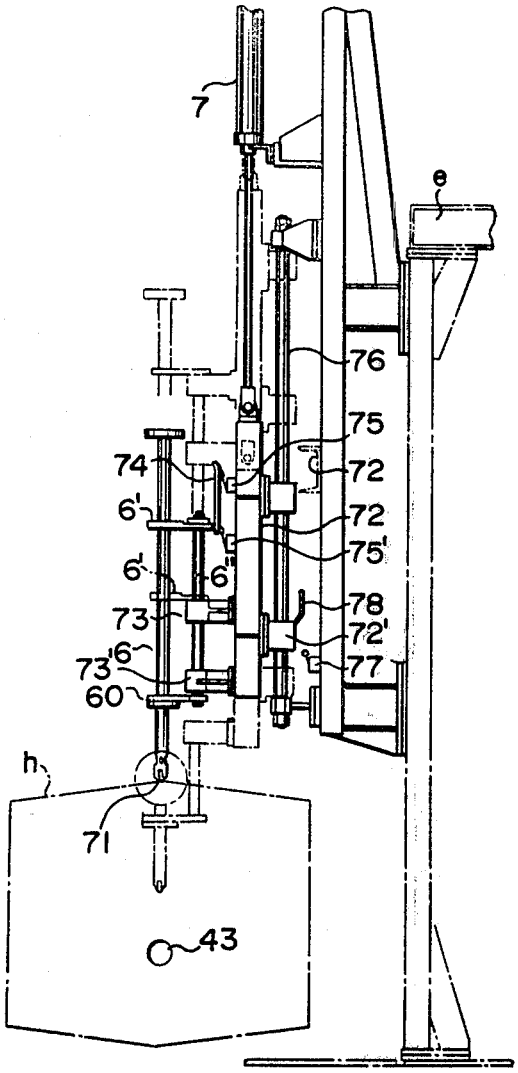
FIG. 17 is a front view of the same means.

By means of the cylinder 7 for raising and lowering the nozzle, the carriage 72 shown in FIGS. 16 and 17 is moved down, and the nozzle 6 supported by the upper bearing 73 is brought down, too. Once the roller 71 at the tip of the nozzle 6 has come into contact with the barrel *h*, it is thereby supported and the nozzle 6 will not drop any more if the carriage 72 is let down farther.

Upon turning of the barrel with its bunghole 43 in position underneath the nozzle 6, the nozzle falls down gravitationally until the stopper 60 hits the surrounding wall of the hole and keeps the nozzle 6 at a constant depth of insertion. The depth of insertion can be adjusted by shifting the position or height of the stopper relative to the nozzle. Once the nozzle has been inserted into the barrel through the bunghole 43, the actuating member 74 provided on the nozzle 6 is away from the upper and lower limit switches 75, 76 on the carriage 72, and in this way the insertion of the nozzle into the barrel is sensed.

FILLING

In the state as shown in FIG. 15(I), where the nozzle 6 is in the empty barrel *h*, the solenoid valve 5 is opened and liquid begins to flwo through the valve into the barrel.

The main turntable *e* repeats the 30° travel at given intervals of time and the barrel is filled up to a predetermined level before it leaves the filling zone shown in FIG. 1.

When the barrel has been filled to a predetermined level (X in FIG. 15(I) where the liquid level is sensed), the vacuum source 62 causes the liquid to rise to a height $h_1$ mm in the equalizing tube 61. The height $h_1$ of the liquid column can be freely changed by varying the degree of vacuum being supplied by the vacuum source 62 or by adjusting the opening of the needle valve 67. In the embodiment being described, there are provided a dozen nozzles 6, each of which accommodates one such equalizing tube 61 which is very small in diameter, and the vacuum is distributed by the same number of needle valves 67 to the nozzles. For this reason the pressure $P_1$ between the vacuum source 62 and the individual needle valves 67 is adjusted to be constant regardless of whether some nozzles 6 have been filled to levels high enough to be sensed or not.

Intrusion of the liquid to the height $h_1$ mm into the equalizing tube 61 provides a vacuum $P_2$ in the pipe 64. The guide tube 65 in communication with the pipe 64 equally attains a vacuum $P_2$. Because the lower portion of the guide tube 65 is immersed in liquid, the liquid is drawn up into the guide tube 65, to a height $h_2$ mm proportional to the vacuum $P_2$. Then, the magnet-carrying float 63 in the guide tube 65 magnetically closes the contacts of the reed switch 68. This, in turn, excites the coil of the solenoid valve 5 to close the valve and shut off the supply of the liquid.

With further rotation of the main turntable *e* each nozzle 6 ascends at the point where the "Nozzle rises" in FIG. 1. This point is so chosen as to ensure the completion of the filling operation despite any irregularity in size of the barrels that may be encountered.

BUNGING

As shown in FIG. 18, the lift 79 supported by the frame 85 is periodically lowered and raised, together with the bunger *f* supported by the lifting shaft 83, by the motor 80 under control by a timer not shown. Should there be no barrel from the preceding station in position while the bunger is coming down, a lower extension 84' at the lower portion of the bracket arm 84 would engage a sensor *x* attached to the lower end portion of the frame 85, so that the absence of barrel can be sensed. The no-barrel signal reverses the operation of the lifting motor 80, and the bunger *f* is automatically raised to the point where another sensor *z* attached to the upper end portion of the frame 85 is engaged with an upper extension 84'' to sense the ascent of the arm 84. Thereupon the bunger is stopped and made ready for the next cycle of bunging operation.

When there is a barrel transferred from the preceding station in position, the sensor bar 88 slidable through the support plates 87, 87' secured to the free end of the bracket arm 84 moves down with the bunger *f* and, upon contact with the barrel surface, slides up through the holes of the support plates 87, 87' as the bunger continues its descent. As the tip of the spring hammer 96 reaches the point best suited for bunging, the fact is detected by the sensor *z* attached to the bunger *f* through its engagement with the flange 89 on top of the sensor bar 88. Then, the bunging motor 90 is started simultaneously with stopping of the lifting motor 80. This permits the pawl 95 keyed to the shaft 94 to be driven by a belt to engage the seat 102 of the spring hammer 96 and lift the hammer 96 against the spring 103.

Consequently, the pawl 95 is turned upward out of engagement with the spring seat 102, and the hammer 96 drops by its own weight combined with the urging of the spring 103 to accomplish bunging. The bung to close the bunghole 43 of each barrel is supplied by a bung feeder *l* (FIG. 1) in the usual manner. It is possible to move the bunger *f* slightly sidewise along an arcuate path about the lifting shaft 83 by some sidewise vibrating means to achieve an increased bunging effect.

DELIVERY OF FILLED BARREL

Each bunged barrel *h'* is transferred from the filler body by the barrel carry-out dolly *b'* to the combined filled-barrel receiver-turntable *a'*. The barrel is thence kicked off obliquely upward by a kicker *k* of lever mechanism or the like associated with the turntable *a'*, onto the conveyor *g'* and carried away to the next station not shown.

If both the combined barrel receiver-turntables *a* and *a'* for empty and filled barrels are installed on separate scales, it will be possible for the operator to compare the weights and find from the difference the quantity of the liquid actually filled in each barrel.

As has been described above, according to the present invention, empty barrels are automatically and continuously fed, their bungholes are automatically located regardless of any irregularity in size of the barrels, and nozzles are automatically inserted into the holes. The nozzle insertion is automatically sensed and, despite any variation in the capacity, the barrels are filled to a constant level. The filled barrels are automatically bunged and continuously carried out of the filler. With these features the present invention reduces the human factor hitherto needed to naught, making it possible to cut down much of the filling cost through the saving of labor. The present invention is commercially advantageous in such applications as automatic cask- or barrel-filling machines for whiskey, beer, wine, liquid chemicals, etc.

What is claimed is:

1. An automatic, continuous barrel-filling method comprising the steps of supplying empty barrels, having bungholes, to dollies for movement of the empty barrels radially towards the periphery of an intermittently rotated turntable; while each empty barrel is supported on a dolly during such radial movement, centering the bunghole axially relative to the dolly; moving the dolly radially to transfer the empty barrel, with its thus axially-centered bunghole, to a carrier on the periphery of the turntable; retracting the dolly from the turntable; engaging a filling nozzle with the barrel in circumferential alignment with the bunghole; rotating the barrel on the carrier at a relatively high speed to detect when the bunghole faces vertically downward; responsive to such detection, halting the high speed rotation with the bunghole less than 180° past its downwardly facing position; rotating the barrel on the carrier at a relatively low speed until the filling nozzle engages into the bunghole when the bunghole faces vertically upward; responsive thereto, immediately halting the low speed rotation of the barrel; then initiating filling of the barrel through the filling nozzle inserted into the barrel through the bunghole; interrupting the filling of the barrel when the liquid level reaches a predetermined height in the barrel; retracting the filling nozzle from the filled barrel; bunging the bunghole of the filled barrel; and then removing the filled barrel from the carrier.

2. An automatic, continuous barrel-filling method, as claimed in claim 1, including providing a series of carriers equiangularly spaced along the periphery of the turntable; following each transfer of an empty barrel, with its axially-centered bunghole, onto a carrier, stepping the turntable a distance equal to the angular spacing between the successive carriers; following each such stepping, moving another dolly radially to transfer an empty barrel, with its axially-centered bunghole, to a respective carrier; engaging a respective filling nozzle with each transfer red barrel in circumferential alignment with the bunghole thereof; while a succeeding empty barrel is being transferred to a carrier, effecting the step of rotating a preceding barrel at such relatively high speed to detect when the bunghole faces vertically downward; then stepping the turntable again to receive a further empty barrel while the initial empty barrel is being rotated at such relatively low speed; then stepping the turntable for transfer of another empty barrel, with its axially-centered bunghole, to a carrier while initiating filling of the initial empty barrel; and continuing such stepping of the turntable during filling of the barrels to such predetermined level of the liquid therein, bunging of the filled barrels, and removal of the filled barrels.

3. An automatic continuous barrel-filling method, as claimed in claim 1, in which the filling nozzle is engaged with the barrel under the force of gravity during rotation of the barrel so that the filling nozzle descends by gravity through the bunghole when the bunghole faces vertically upward.

4. An automatic, continuous barrel-filling method, as claimed in claim 2, in which each filled barrel is removed from its associated carrier by transfer of the filled barrel to a removing dolly moved radially relative to the turntable while the turntable is halted between such stepping thereof.

5. An automatic, continuous barrel-filling method, as claimed in claim 4, including the steps of transferring the filled barrels from the removal dolly to a filled barrel receiver-turntable; and then transferring the filled barrels from the filled-barrel receiver-turntable to a filled-barrel removal conveyor.

6. An automatic, continuous barrel-filling method, as claimed in claim 2, comprising the steps of providing an empty-barrel receiver-turntable and a conveyor extending to the latter; supplying empty barrels along the conveyor to the empty-barrel receiver-turntable; and successively transferring empty barrels from the empty-barrel receiver-turntable to the dolly for movement of the empty barrels radially toward the intermittently rotated turntable.

7. An automatic, continuous barrel-filling method, as claimed in claim 2, including the steps of providing a source of vacuum; connecting the source of vacuum through each filling nozzle, in sealed relation to the interior of the filling nozzle, to an outlet communicating with the interior of the barrel at a level above the liquid outlet of the filling nozzle; and, responsive to the liquid level in the barrel reaching such outlet and thus altering the vacuum in the connection to said source of vacuum, interrupting the filling of the barrel.

* * * * *